US006776069B2

(12) United States Patent
Soreo et al.

(10) Patent No.: US 6,776,069 B2
(45) Date of Patent: Aug. 17, 2004

(54) BATTERY POWERED SCREWDRIVER AND SCREW STARTING DEVICE

(75) Inventors: Robert F. Soreo, Cleveland Heights, OH (US); Bernard Schaub, University Heights, OH (US); David B. Levine, Pepper Pike, OH (US)

(73) Assignee: Toolovation, LLC, Beachwood, OH (US)

( * ) Notice: Subject to any disclaimer, the term of this patent is extended or adjusted under 35 U.S.C. 154(b) by 0 days.

(21) Appl. No.: 10/184,092

(22) Filed: Jun. 25, 2002

(65) Prior Publication Data

US 2003/0070511 A1 Apr. 17, 2003

Related U.S. Application Data

(60) Provisional application No. 60/300,744, filed on Jun. 25, 2001.

(51) Int. Cl.[7] ..... B25B 21/00; B25B 23/10

(52) U.S. Cl. ..... 81/54; 452/458; 452/451

(58) Field of Search ..... 81/451, 452, 456, 81/458, 54, 13; D8/82, 71

(56) References Cited

U.S. PATENT DOCUMENTS

| | | | | | |
|---|---|---|---|---|---|
| 643,040 | A | * | 2/1900 | Carvin et al. | 81/452 |
| 881,298 | A | * | 3/1908 | Chappel | 81/452 |
| 1,457,457 | A | * | 6/1923 | Peyer | 81/451 |
| 1,810,704 | A | * | 6/1931 | Gentry | 81/456 |
| 3,243,023 | A | | 3/1966 | Boyden | |
| 3,308,684 | A | | 3/1967 | Wilkinson et al. | |
| 3,329,185 | A | | 7/1967 | Hettich et al. | |
| 3,633,640 | A | | 1/1972 | Moore | |
| 3,810,502 | A | | 5/1974 | Kyser | |
| 3,927,893 | A | | 12/1975 | Dillon et al. | |
| 4,139,036 | A | | 2/1979 | Regan et al. | |
| 4,221,249 | A | | 9/1980 | Mazzeo et al. | |
| D272,230 | S | | 1/1984 | Hanks | |
| D273,657 | S | | 5/1984 | Hanks | |
| 4,526,072 | A | | 7/1985 | Manhoff, Jr. | |
| 4,581,963 | A | | 4/1986 | Kim | |
| 4,704,929 | A | | 11/1987 | Osada | |
| 4,719,828 | A | | 1/1988 | Corsetti | |
| 4,736,658 | A | | 4/1988 | Jore | |
| D297,104 | S | | 8/1988 | Svetlik | |
| 4,804,048 | A | | 2/1989 | Porth, Jr. | |
| 4,862,774 | A | | 9/1989 | Else et al. | |
| 4,878,405 | A | | 11/1989 | Wolfe | |
| 4,951,756 | A | | 8/1990 | Everett et al. | |
| 5,016,501 | A | | 5/1991 | Holzer, Jr. | |
| 5,096,213 | A | | 3/1992 | Terwilliger et al. | |
| 5,129,292 | A | | 7/1992 | Albert | |
| 5,437,465 | A | | 8/1995 | Vogele et al. | |
| 5,496,139 | A | | 3/1996 | Ghode et al. | |

(List continued on next page.)

FOREIGN PATENT DOCUMENTS

| | | | |
|---|---|---|---|
| DE | 3513600 | * | 4/1985 |

*Primary Examiner*—D. S. Meislin
(74) *Attorney, Agent, or Firm*—Benesch, Friedlander, Coplan & Aronoff LLP

(57) ABSTRACT

A power tool comprising a housing having a member disposed therein and a spindle for receipt of a tool bit wherein the spindle is retained on a shaft. The spindle and shaft define an axis of rotation relative to the housing. The power tool further comprises a collet having a sleeve that includes a collet engaging portion disposed on an inner surface of the sleeve and an opening centered on the axis for passage of the shaft therethrough and for receiving the member disposed in said housing to permit axial sliding movement between a locked position and an unlocked position. The power tool further comprises a spindle engaging portion disposed on the spindle wherein the spindle engaging portion engages with the collet portion means when the collet is moved in the locked position thereby rigidly locking the collet and the spindle together to prevent rotational movement of the spindle.

8 Claims, 10 Drawing Sheets

U.S. PATENT DOCUMENTS

| | | | |
|---|---|---|---|
| 5,531,549 | A | 7/1996 | Fossella |
| 5,660,091 | A | 8/1997 | Stone et al. |
| 5,903,983 | A | 5/1999 | Jungmann et al. |
| 5,984,022 | A | 11/1999 | Hannan, Jr. et al. |
| 5,988,957 | A | 11/1999 | Wheeler |
| 6,079,716 | A | 6/2000 | Harman, Jr. et al. |
| 6,102,411 | A | 8/2000 | Wilson |
| 6,139,228 | A | 10/2000 | Longo |
| 6,196,554 | B1 | 3/2001 | Gaddis et al. |
| 6,273,200 | B1 | 8/2001 | Smith et al. |

* cited by examiner 52
527
555
530
545
540
520
550
525
515
552
510
535
A
A
SECTION A-A

BATTERY POWERED SCREWDRIVER AND SCREW STARTING DEVICE

CROSS-REFERENCE TO RELATED APPLICATIONS

This application claims the benefit of U.S. Provisional Application No. 60/300,744 filed on Jun. 25, 2001.

BACKGROUND OF THE INVENTION

The present invention relates generally to tools and more particularly to a battery powered tool for driving screws, the battery powered tool including a screw starting device.

Manually tightening screws is a slow, time consuming procedure that is very tiring to a person's hand and arm. It is well known that the torque or force which must be applied to a screw can vary substantially as the screw is advanced into anchoring engagement with an associated surface. A battery powered screwdriver is a typical tool for applying this torque to a screw to complete the engagement of the screw with the associated surface. Battery powered screwdrivers typically do not have the high-torque capability necessary to complete the engagement process available from a conventional screwdriver. The present invention combines in a single tool, the high speed effortless drive capability of a battery powered screwdriver with the high torque feature of a manual screwdriver required to set screws.

SUMMARY OF THE INVENTION

According to one aspect, the invention provides a battery powered screwdriver with a high torque feature.

A further aspect of this invention is to provide a battery powered screwdriver using an alkaline battery pack enabling the screwdriver to be stored for an extended period of time with retained battery life.

A further aspect of this invention is to employ a locking device which upon being activated causes the battery operated screwdriver to operate as a manual screwdriver.

A further aspect of this invention is to provide a device for setting a screw, with which a screw can be readily and reliably attached to the tip end of a battery operated screw driver.

In one embodiment, the present invention provides for a hand-held power tool comprising a housing having a member disposed therein and a spindle for receipt of a tool bit wherein the spindle is retained on a shaft The spindle and shaft define an axis of rotation relative to the housing. The power tool further comprises a collet having a sleeve that includes a collet engaging portion disposed on an inner surface of the sleeve and an opening centered on the axis for passage of the shaft therethrough and for receiving the member disposed in said housing to permit axial sliding movement between a locked position and an unlocked position. The power tool further comprises a spindle engaging portion disposed on the spindle wherein the spindle engaging portion engages with the collet portion means when the collet is moved in the locked position thereby rigidly locking the collet and the spindle together to prevent rotational movement of the spindle. The tool of claim 1, wherein the rigidly locking of the collet and the spindle permits operation of the power tool in a manual mode in which rotational forces applied to the housing are directly transmitted to the spindle and tool bit therein. Optionally, the opening in the collet has a non-circular cross-section and the member has a matching non-circular cross-section thereby preventing rotation of the collet about the axis with respect to the housing in either the locked or unlocked positions. The collet may further comprise exposed means for urging the collet in the locked position such as a pair of ears that extend from an outer surface of the collet. Preferably, the spindle engaging portion comprises a plurality of teeth extending axially from the spindle thereby forming a plurality of recesses therebetween and wherein collet engaging portion comprises a plurality of teeth extending radially from the inner surface of the sleeve thereby forming a plurality of recesses therebetween, said plurality of teeth on the spindle mesh with the plurality of recesses in the collet and said plurality of teeth in collet mesh with the plurality of recesses in the spindle to create a rigid locking engagement between the collet and the spindle thereby preventing rotation of the spindle in the locked position.

In another embodiment, the present invention provides for a spindle locking device for use in a hand-held power tool wherein the hand-held power tool includes a housing having a member disposed therein, a shaft, and a spindle mounted on the shaft, the spindle locking device comprising a collet having a sleeve that includes a longitudinal axis and an inner surface. The sleeve includes collet engaging means disposed radially on the inner surface thereof. Further, the sleeve defines an opening centered on the axis for passage of the shaft therethrough and for receiving the member disposed in said housing to permit axial sliding movement of the collet relative to the member between a locked position and an unlocked position. The spindle locking device further comprises spindle engaging means disposed on the spindle wherein the spindle engaging means mesh with the collet engaging means when the collet is moved in the locked position thereby rigidly locking the collet and the spindle to prevent rotational movement of the spindle.

In another embodiment, the present invention provides for a spindle locking device for use in a hand-held power tool wherein the hand-held power tool includes a housing having a member disposed therein, a shaft defining an axis of rotation, and a spindle coaxially mounted on the shaft for receipt of a tool bit therein, the spindle locking device comprising a collet having a body including a longitudinal axis, a proximal portion and a distal portion. The body includes a radial wall disposed between the proximal and distal portions of the body wherein the wall has an inner surface facing the proximal portion and an outer surface facing the distal portion. The wall further includes collet engaging means that extend axially from the outer surface of the wall, and a sleeve extending axially from the inner surface of the wall defining an opening centered on the axis for passage of the shaft therethrough and for receiving the member disposed in said housing to permit axial sliding movement between a locked position and an unlocked position. The spindle locking device further comprises spindle engaging means disposed on the spindle wherein the spindle engaging means mesh with the collet engaging means when the collet is moved in the locked position thereby rigidly locking the collet and the spindle to prevent rotational movement of the spindle. Preferably, the collet body is conically shaped. Preferably, the spindle engaging means comprise a plurality of teeth extending axially from the spindle thereby forming recesses therebetween and wherein collet engaging means comprises a plurality of teeth extending axially from said outer surface of the wall thereby forming recesses therebetween, said plurality of teeth on the spindle mesh with the pluraility of recesses in the collet and said plurality of teeth in collet mesh with the plurality of recesses in the spindle to create a rigid locking engagement between the collet and the spindle thereby preventing rotation of the spindle in the locked position.

In an alternative embodiment, the present invention provides for a screw starter device for use alone or in combination with the screwdriver according to the present invention. The screw starter device temporarily holds a screw while starting it into a substrate. The screw starter device comprises a tubular member defined by a proximal end portion, a distal end portion and a central body portion. An arcuate opening large enough to admit the head of a screw is positioned in the side of the body portion. A first longitudinal slot large enough to admit the shank of the screw extends through the side of the body portion towards the distal end. A latitudinal slot positions the head of a screw and is located on the body portion opposite the arcuate opening. A second longitudinal slot is located on the body portion opposite the first longitudinal slot. The inside surfaces engage and hold the screw in the screw holder and release the screw once the advancement of the screw is completed. Preferably, the screw holder device is consturced of a plastic material such that the distal end of the screw starter device can expand and allow the screw to be released once the advancement of the screw is completed. The distal end will elastically return to its original state, ready to accept another screw, once the screw is released.

DETAILED DESCRIPTION OF THE PREFERRED EMBODIMENTS

Figure 1:
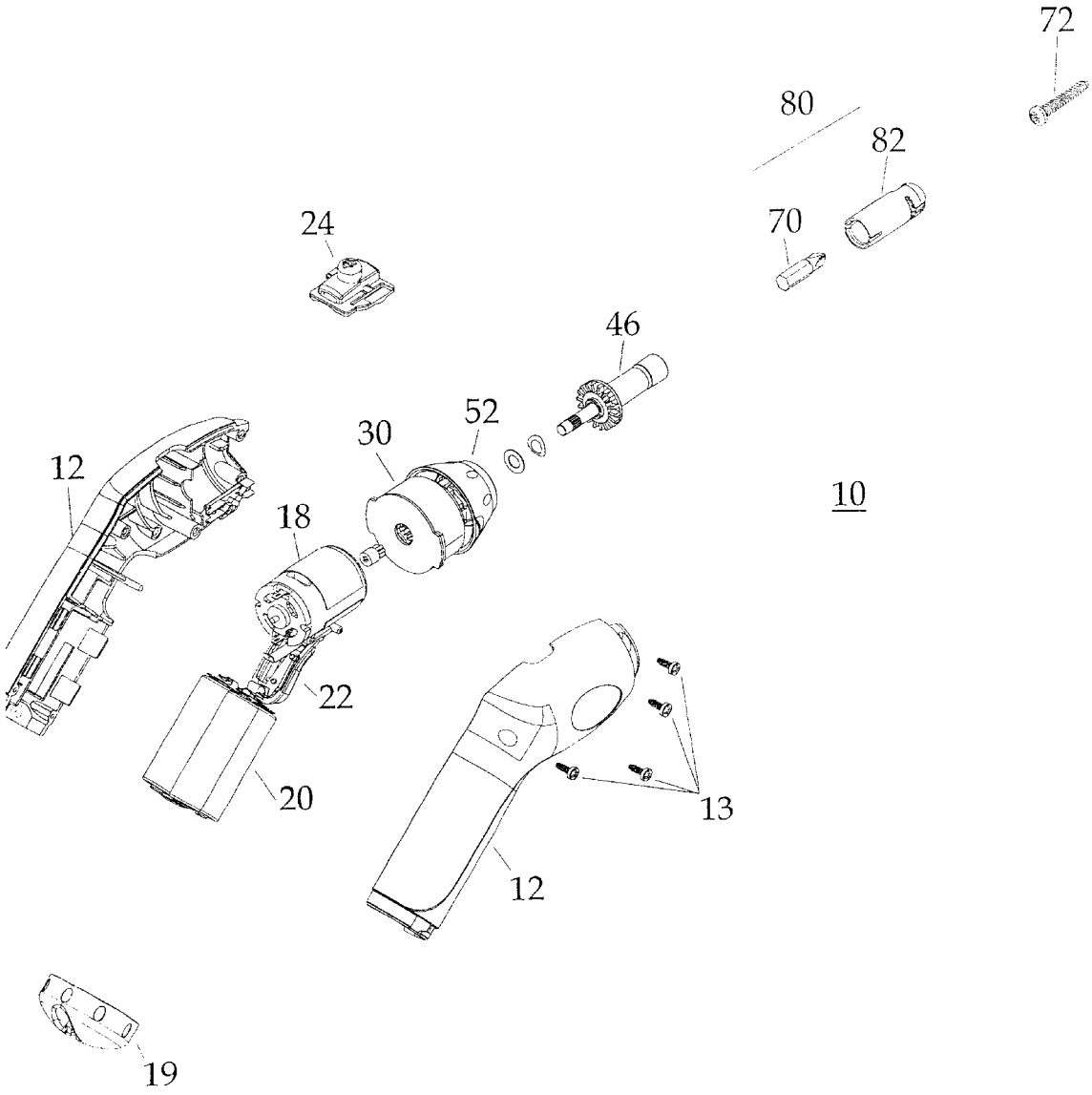
FIG. 1 is an exploded perspective view of the battery operated screwdriver.
Figure 2:
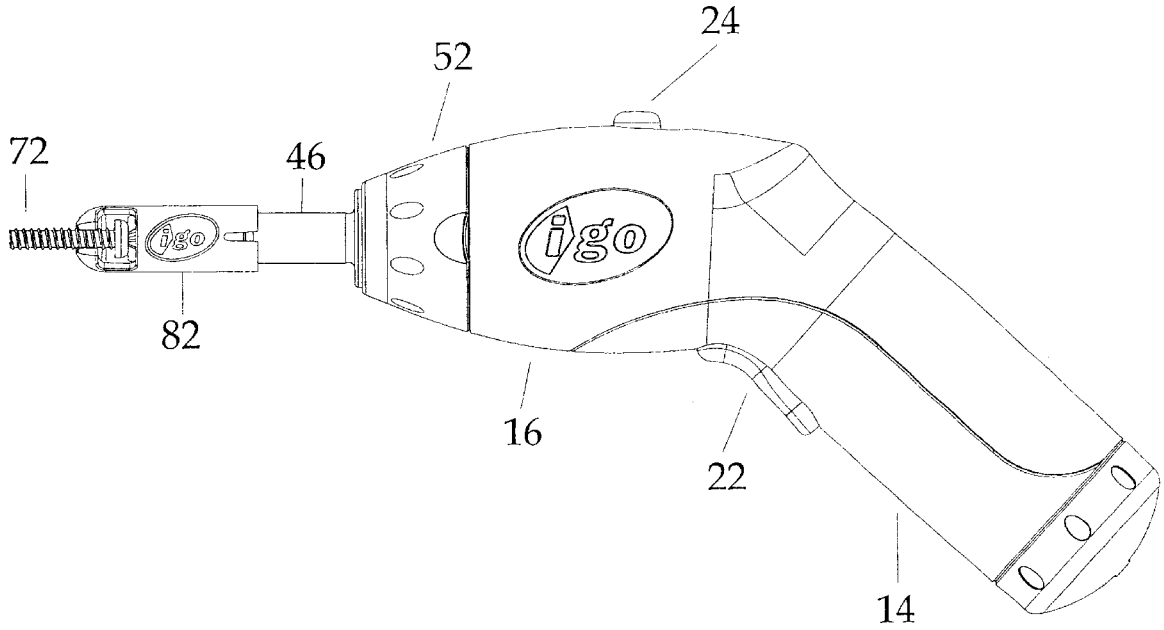
FIG. 2 is a side elevation view of the battery operated screwdriver.
Figure 3:
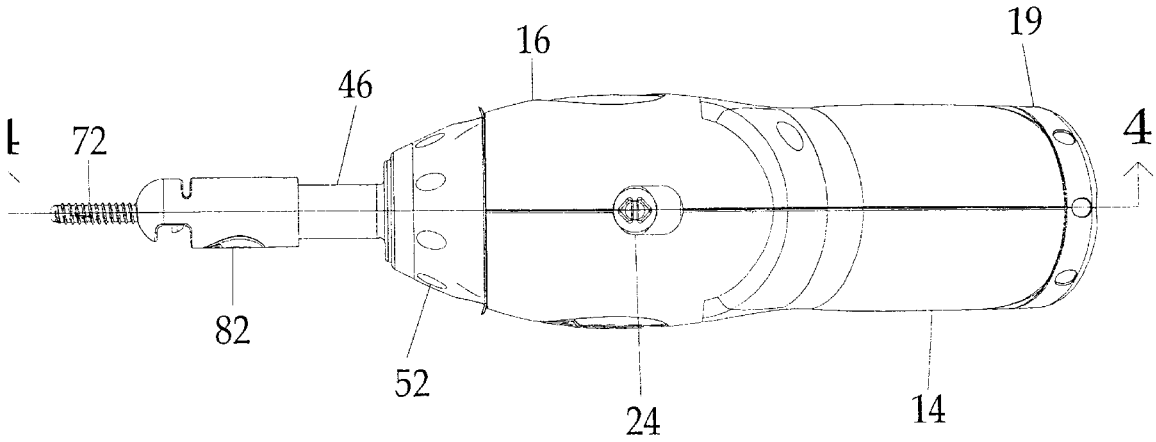
FIG. 3 is a top view of the battery operated screwdriver.

Referring now to drawings, as shown in FIGS. 1, 2 and 3, A battery powered screwdriver 10 according to the present invention comprises a housing including a pair of plastic side members 12 defining a tool handle 14 and a front gear housing 16. A compact reversible direct current (DC) motor 18 is secured within the pair of plastic side members 12. The pair of plastic side members 12 are held together by screws 13 as shown in FIG. 1. A source of electrical energy is provided to motor 18 from an alkaline battery pack 20 located in handle 14. A cap 19 is located on the end of the handle 14 so that the battery pack can be removed and a new battery pack installed when needed. The battery and motor are electrically interconnected through on-off trigger switch 22.

Screwdriver 10 contains a spindle 46 that extends from the forward end of housing 16 and receives a tool head 80. The tool head 80 will normally take the form of a phillips screwdriver bit 70, but can also take the form of other screwdriver heads, such as a conventional flat head, or can take the form of other types of tools. The tool head 80 also includes a screw starter device 82.

Screwdriver 10 preferably includes a screw starter device 82 for temporarily holding a screw 72 while starting it into a substrate. Screw starter device 82 is shown attached to the screwdriver 10 in side view in FIG. 2 and in top view in FIG. 3.

Figure 4:
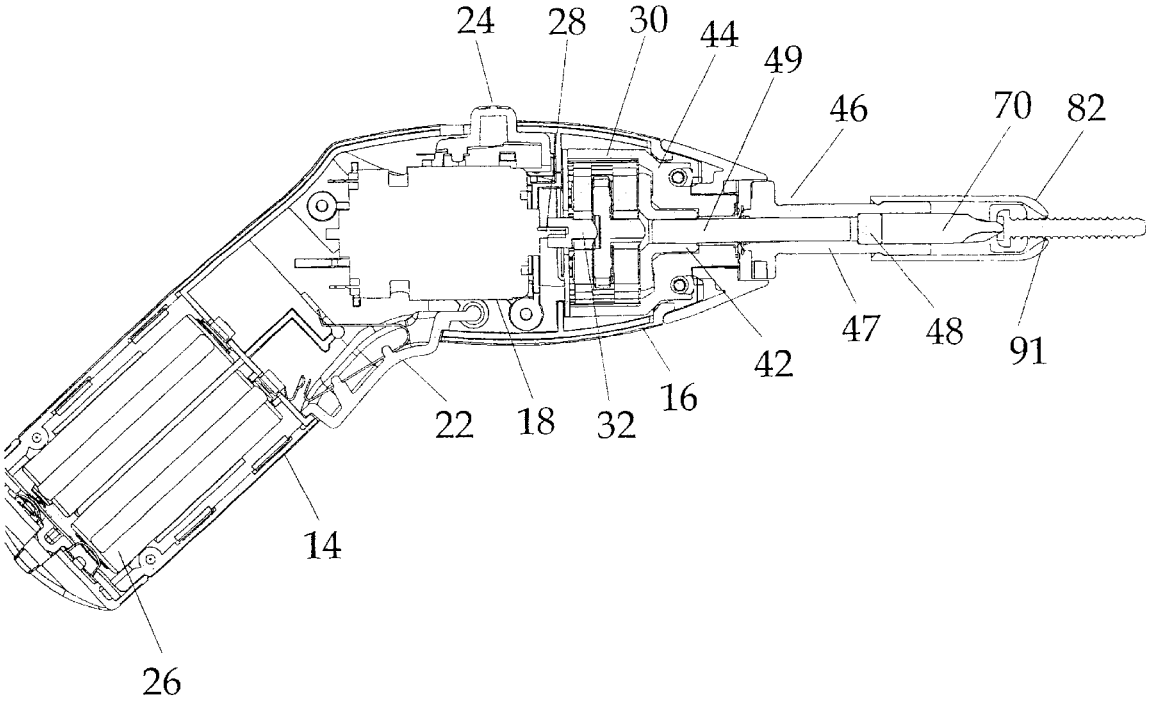
FIG. 4 is a cross-sectional view taken along line 4—4 of FIG. 3.

Referring now to FIG. 4, trigger switch 22 operates in the customary manner to initiate powered operation of the tool and is retained within handle 14. Forward-reverse switch 24 functions to selectively reverse the electrical polarity of the alkaline battery 26 as connected to the motor 18, thereby, selectively reversing the direction of motor rotation. In this manner, the corresponding direction of bit rotation may be chosen to permit the advance or removal of a particular screw as appropriate.

Figure 5A:
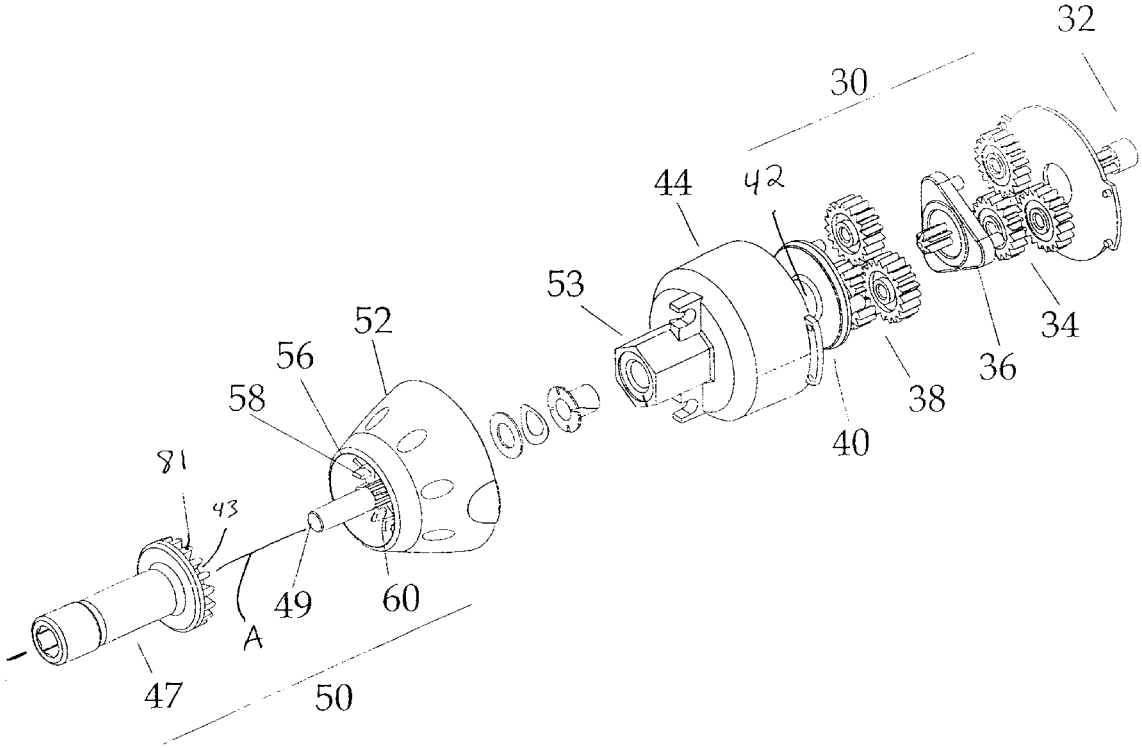
FIG. 5A is an exploded view of the internal components located in the gear case assembly.

As shown in FIGS. 4 and 5, armature shaft 28 of motor 18 has motor pinion gear 32 mounted thereon within gear case assembly 30. Motor pinion gear 32 extends forwardly from the motor into engagement with a first planetary gear assembly 34 in housing 16. Each stage of the gear reduction utilizes a gear train and a planet gear support, in this well known manner, for speed reduction of the second shaft on the planetary gear train with respect to the motor gear.

Stage one reduction includes motor pinion gear 32 and first planetary gear assembly 34 with gears rotatably retained on planet support 36. The second stage reduction comprises gear assembly 38 with gears rotatably retained on planet support 40. As shown in FIG. 4, planet support 40 includes planet support drive shaft 42 that fits into gear housing 44. Pin 49 is press fit into planet support drive shaft 42 and press fit onto spindle drive shaft 47 connecting the gear drives to the spindle and transferring the gear drive output torque to spindle 46. Each set of gears 34, 36 and 38, 40 are rigidly interconnected in gear housing 30. The two-stage speed reduction assembly produces approximately a 64 times reduction of shaft speed to about a 125 rpm spindle velocity. Each planetary gear speed reduction is approximately eight to one.

Figure 6:
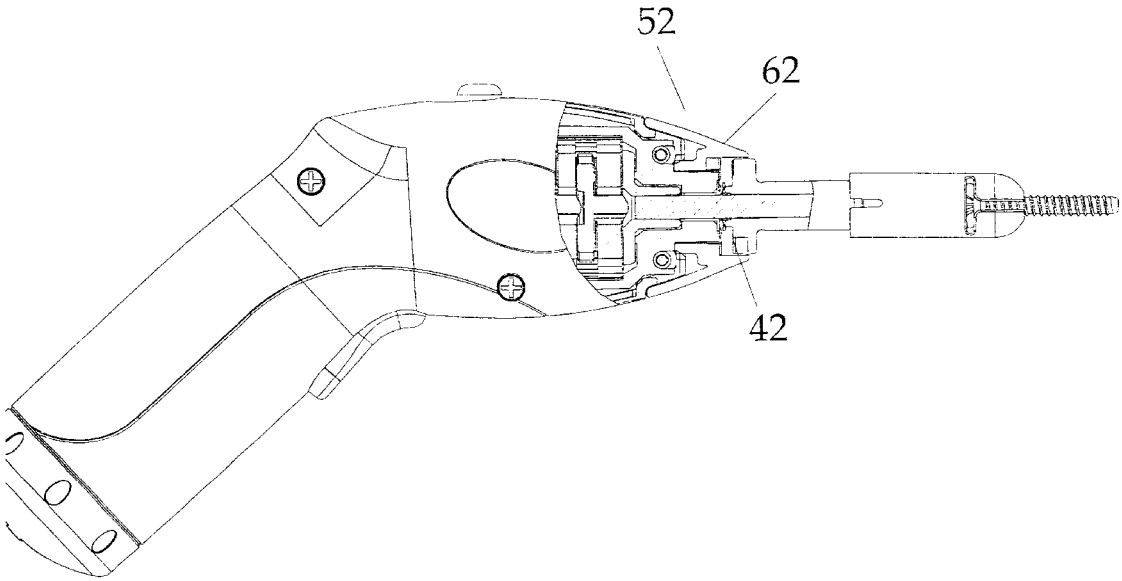
FIG. 6 is a fragmentary side elevation view showing the collet spindle in the unlocked position.
Figure 7:
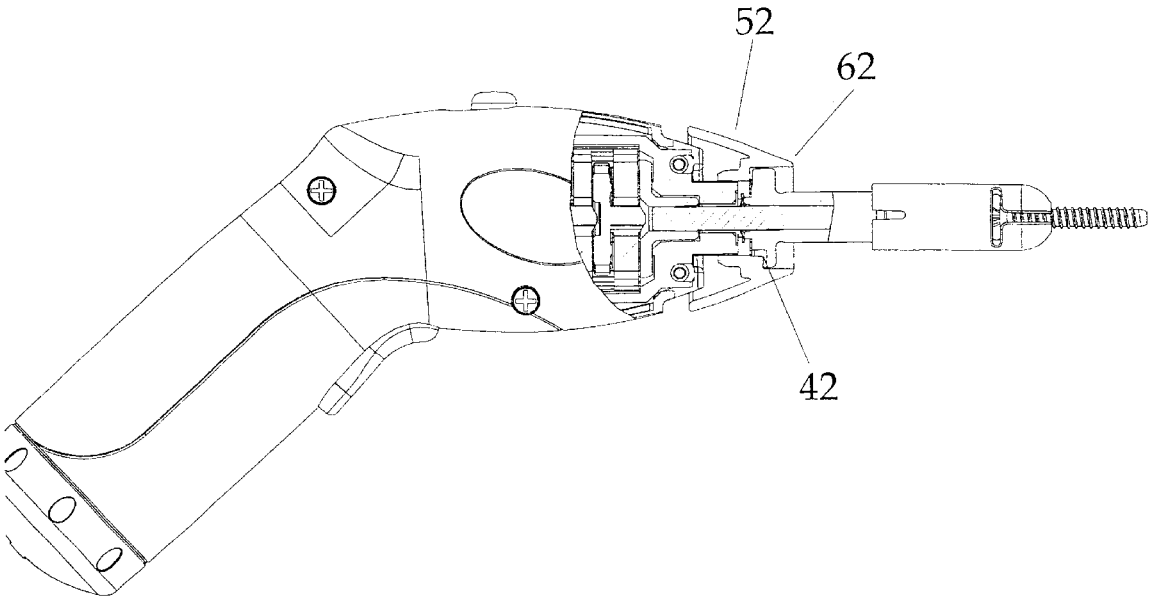
FIG. 7 is a fragmentary side elevation view showing the collet spindle in the locked position.
Figure 8:
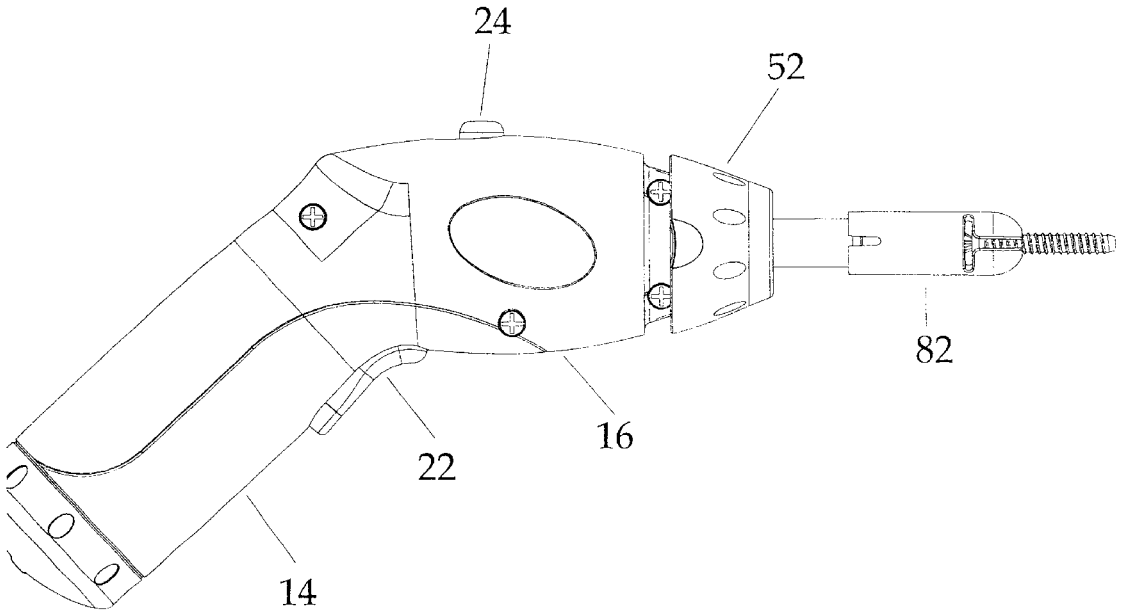
FIG. 8 is a side view of the front housing taken in side elevation showing the spindle and collet positioned in the locked position.

A spindle locking assembly 50 is provided to rigidly retain spindle 46 in fixed relationship to housing 16. When spindle 46 is locked, the user may utilize the entire tool 10 as a manual screwdriver by grasping handle 14 in the customary fashion and urging the tool into rotation about the spindle axis A. Referring to FIG. 5, this is accomplished by the use of spindle locking assembly 50 which includes an actuator ring or collet 52 adapted for reciprocal movement along the spindle axis between an "unlocked" position (i.e., where spindle 46 is free to rotate relative to housing 16), as shown in FIG. 6, and a "locked" position (i.e., where spindle 46 is prevented from rotating relative to housing 16), as shown in FIGS. 7 and 8. It will be appreciated that the collet 52 used to lock/unlock spindle 46 may be readily and repeatedly actuated as necessary with a minimum of lost time or work interruption and generally without the need of removing the tool from engagement with the work piece or screw.

Collet 52 is retained for sliding engagement with spindle 46 along shaft 53 and is adapted for movement between an unlocked and a locked position. The hexagonal shape of shaft 53 acts to prevent rotation of collet 52 about axis A. Although shaft 53 has a hexagonal cross-section, one skilled in the art would appreciate that any cross section could be utilized to prevent rotation of collet 52 such as a non-circular, triangular, square, or other polygonal cross-section.

Figures 5B, 5C, 5D:
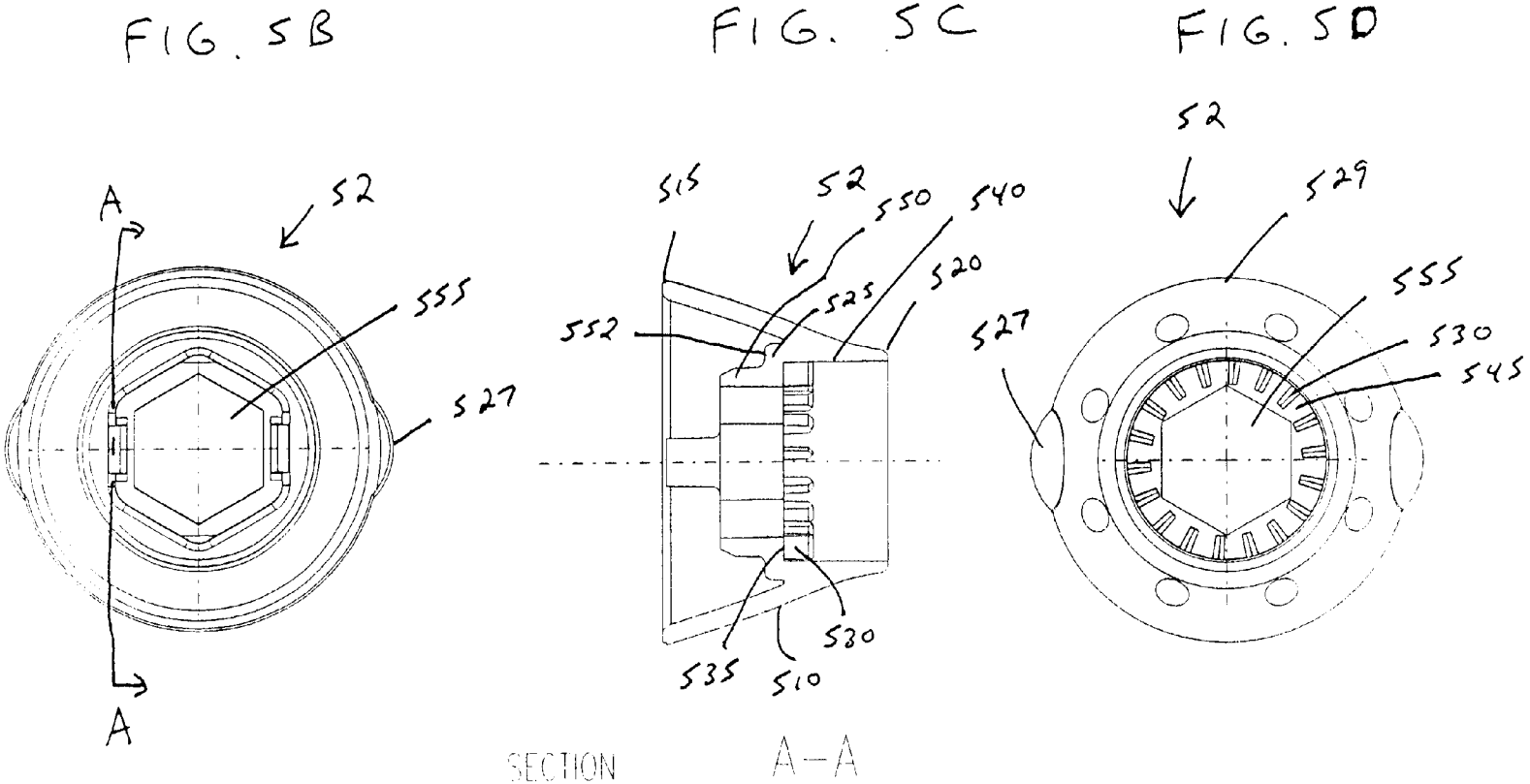
FIG. 5B illustrates a rear view of collar 52 according to the present invention.
FIG. 5C illustrates a cross-sectional view taken along line A—A of FIG. 5B.
FIG. 5D illustrates a front view of collar 52 according to the present invention.

As best shown in FIG. 5 and FIG. 7, the spindle lock assembly 50 according to the present invention comprises collet 52 adapted to engage with spindle 46 and in sliding communication with shaft 53. As shown in FIGS. 5B–5D, collet 52 comprises a body 510 having a proximal portion 515, a distal portion 520, and a radial wall 525 disposed therebetween. Preferably, body 510 includes a pair or ears 527 that project out away from the outer surface 529 of body 510. Ears 527 provide the user with a pair of surfaces to urge collet 52 away from housing 16. Although the pair of ears 527 is one preferred exposed means for urging collet 52 away from housing 16, one skilled in the art would recognize that other exposed means are within the scope of this invention. Collet engaging teeth 530 extend axially from an outer surface 535 of wall 525 towards the distal portion 520 and are spaced uniformly about axis A thereby forming axial recesses 545 between said teeth 530. Preferably, teeth 530 are also connected to the inner surface 540 of body 510. Alternatively, teeth 530 may be radially disposed on the inner surface 540 of body 510 without being in contact with the outer surface 535 of wall 525. Although the preferred engaging means is teeth mating with recesses, one skilled in the art would appreciate that other engaging means may be utilized such as pins mated in holes, at least one non-circular opening receiving a matching member, and other means known in the art.

Sleeve 550 extends axially towards the proximal portion 515 from an inner surface 552 of wall 525 defining an opening 555 having a hexagonal cross-section centered on axis A. Opening 555 permits passage of pin 49 therethrough and receives shaft 53 that has a hexagonal cross-section to permit axial sliding movement between the unlocked position and the locked position. Although opening 555 has a hexagonal cross-section, one skilled in the art would appreciate that any cross-section could be utilized such as a non-circular, triangular, square, or other polygonal cross-section. Preferably, the shape of opening 555 cross-section is the same as the shape of the shaft 53 cross-section to prevent "slop" between the engagement of shaft 53 and collet 52. To prevent "slop" between the two parts, the clearance therebetween should be minimal, yet enough to provide free axial movement of collet 52 along shaft 53.

Spindle engaging teeth 81 are integrally formed on, and extend outwardly from the end of spindle 46 thereby forming axial recesses 43 therebetween. When collet 52 is positioned in the locked position, collet engaging teeth 530 mate with corresponding recesses 43 on spindle 46 and spindle engaging teeth 81 mate with corresponding recesses 545 on collet 52 thereby rigidly locking spindle 46 against collet 52 to prevent rotation of spindle 46. This mating in the locked positioned is hereinafter referred to as "meshing the collet engaging teeth 530 with the spindle locking teeth 81."

Spindle 46, as best shown in FIG. 4 and FIG. 5, includes a shaft portion 47 including a magnet 48 inserted in the distal end adapted to retain a screwdriver bit 70 therein. Outward sliding movement of collet 52 from the unlocked position of FIG. 6 to the locked position of FIG. 7, assures the mutual engagement of spindle 46 and collet 52.

In operation, collet 52 is ordinarily positioned in the unlocked position, FIG. 6, wherein the collet engaging teeth 530 on collet 52, as shown in FIG. 5, are retracted from engagement with recesses 43 on spindle 46. Thus, spindle 46 and bit 70 may freely rotate whenever the user activates the tool trigger switch 22. With the forward-reverse switch 24 in the 'forward' position, for example, a screw may then be driven or advanced into the work piece. As illustrated in FIG. 7, on the event that torque forces above the limit of the instant portable tool are encountered, the user, after deactivating switch 22, simply pushes the pair of ears 527 on collet 52 urging it axially towards the work piece into the locked position of FIG. 7. It will be appreciated that a modest force must initially be applied to the ears 527 of collet 52 to mesh the collet engaging teeth 530 with the spindle locking teeth 81.

The user may then utilize the powered screwdriver in its manual mode simply by urging the rotation of the entire tool assembly about axis A. Although compact in overall size and weight, the housing of the instant tool serves as an excellent handle means permitting the applications of significant torque forces. The instant tool may readily be returned to its powered mode of operation by repositioning the collet in the original position. It will be appreciated that the collet locking arrangement of this invention is particularly suited for ease of mode switching thereby permitting fast and effortless transitions between the powered and manual modes of tool operation. In this way, the user can efficiently set or remove a substantial quantity of screws without the bother of repeatedly switching from one tool to another.

Figure 10:
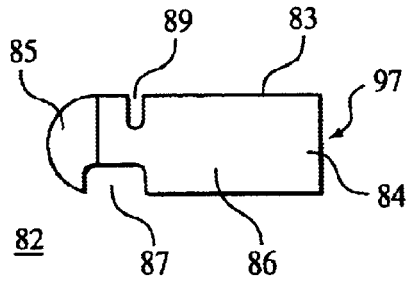
FIG. 10 is a side view of the screw holder illustrating the arcuate opening of the screw holder.
Figure 9:
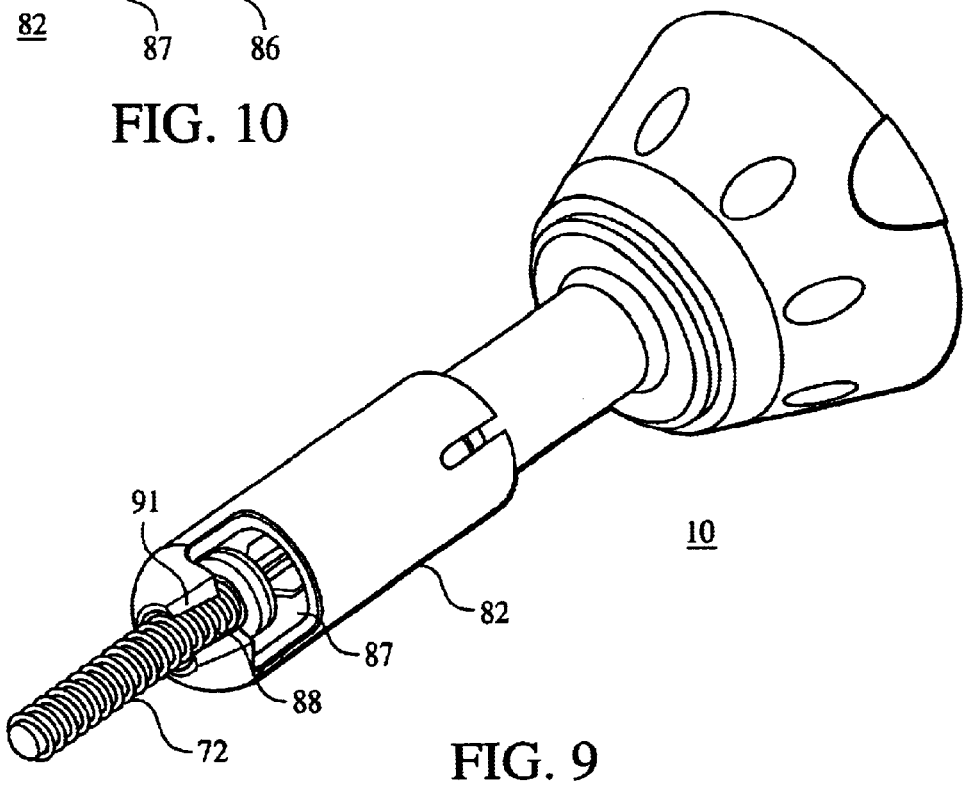
FIG. 9 is a perspective view of the screw holder attached to the battery operated screwdriver and holding a screw.
Figure 11:
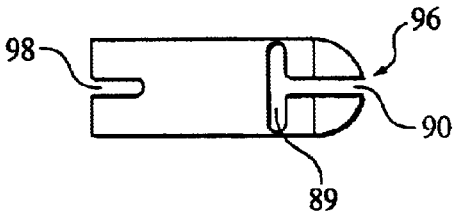
FIG. 11 is a side view of the screw holder illustrating the latitudinal slot of the screw holder.

In an alternative embodiment, as illustrated in FIGS. 9–11, the present invention provides for a screw starter device 82 for use alone or in combination with the screwdriver 10 described above. Screw starter device 82 temporarily holds a screw 72 while starting it into a substrate. The screw starter 82 is also shown attached to the screwdriver 10 in side view in FIG. 2 and in top view in FIG. 3.

Figure 12:
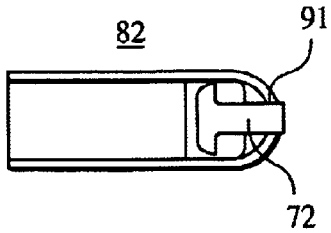
FIG. 12 is a section view illustrating the inside surfaces of the screw holder holding a screw.

As illustrated in FIGS. 9–11, the screw starter device 82 comprises a tubular member 83 defined by a proximal end portion 84, a distal end portion 85 and a central body portion 86. The distal end portion 84 can include a shank receiving opening 96 to receive the shank of a screw and the proximal end portion can include a spindle receiving opening 97 for removable mounting of the device 82 to a tool spindle. An arcuate opening 87 large enough to admit the head of a screw is positioned in the side of body 86. A first longitudinal slot 88 large enough to admit the shank of the screw extends through the side of body portion 86 to the distal end 85. A latitudinal slot 89 positions the head of a screw and is located on the body portion 86 opposite arcuate opening 87. A second longitudinal slot 90 is located on the body portion 86 opposite first longitudinal slot 88. In one embodiment, the proximal end portion 84 can include at least one relief slot 98 in communication with the spindle receiving opening 97 to permit the tubular member 83 to expand to fit oversized tool spindles. As shown in section in FIG. 12, the inside surfaces 91 engage or grab the screw 72 in screw holder 82 and release the screw, once the advancement of the screw is complete.

In a preferred embodiment of the screw starter device, the device 82 is about 2 inches long and ½ inch in diameter. The device 82 can be made of plastic or a comparable material. The plastic material is such that the distal end 85 of the screw holder 82 can expand and allow the screw 72 to be released once the advancement of the screw is completed. The distal end 85 once the screw 72 is released will elastically return to its original state, ready to accept another screw.

Although the invention has been shown and described with respect to certain embodiments, it is obvious that equivalent alterations and modifications will occur to others skilled in the art upon reading and understanding of the specification. The present invention includes all such equivalent alterations and modifications.

We claim:

1. A device for temporarily holding a screw prior to driving such screw into a substrate wherein said screw has a head and a shank, said device comprising:

a tubular member having a proximal end, a body portion, and a tapered portion extending from said body portion terminating into a distal end, said distal end having a shank receiving opening to receive the shank of such screw, said proximal end having a spindle receiving opening for removable mounting of said device to a tool spindle, said body portion includes a head receiving opening to receive the head of such screw, said tapered portion includes a first longitudinal slot to receive the shank of such screw, said first longitudinal slot being in communication with said shank receiving opening and said head receiving opening, said tapered portion includes a second longitudinal slot opposite said first longitudinal slot and being in communication with said shank receiving opening to provide relief to said tapered portion of said tubular member during advancement of such screw.

2. The device of claim 1, wherein said second longitudinal slot extends into said body portion terminating at a first end.

3. The device of claim 2, wherein said body portion further comprises a latitudinal slot opposite said head receiving opening to position the head of such screw, said latitudinal slot having a central portion that is in communication with said first end of said first longitudinal slot.

4. The device of claim 1, wherein the body portion includes at least one relief slot in communication with said spindle receiving opening to permit said tubular member to expand to fit oversized tool spindles.

5. The device of claim 1, wherein said tubular member is constructed of a plastic material.

6. A screw starter device wherein said screw has a head and a shank, said device comprising:

a tubular member having a proximal end portion, a body portion, and a pair of fingers extending from said body portion and terminating into a distal end portion, said distal end portion having a shank receiving opening to receive the shank of such screw, said proximal end portion having a spindle receiving opening for removable mounting of said device to a tool spindle, said pair of fingers being separated by a first longitudinal slot dimensioned to receive the shank of such screw, a head receiving opening in communication with said first longitudinal slot and dimensioned to receive the head of such screw, and a second longitudinal slot opposite said first longitudinal slot and dimensioned to provide relief to said pair of fingers during advancement of such screw, said first longitudinal slot being in communication with said shank receiving opening and said head receiving opening.

7. The device of claim 6, wherein each of said pair of fingers includes a tapered portion that tapers towards said distal end of said tubular member.

8. The device of claim 6, wherein the proximal end portion includes at least one relief slot in communication with said spindle receiving opening to permit said tubular member to expand to fit oversized tool spindles.

* * * * *